US006053786A

United States Patent [19]

Mishima et al.

[11] Patent Number: 6,053,786

[45] Date of Patent: Apr. 25, 2000

[54] EXHAUST APPARATUS OF OUTBOARD MOTOR

[75] Inventors: Shuichi Mishima, Iwata; Toshio Watanabe; Hidetsugu Shimada, both of Hamamatsu; Katsuhiro Fukuda, Shizuoka-ken; Jun Itoh, Hamamatsu; Satoru Takahashi, Hamamatsu; Shuichi Hagino, Hamamatsu, all of Japan

[73] Assignee: Suzuki Kabushiki Kaisha, Hamamatsu, Japan

[21] Appl. No.: 09/090,154

[22] Filed: Jun. 2, 1998

[30] Foreign Application Priority Data

Jun. 4, 1997 [JP] Japan ..... P9-146743

[51] Int. Cl.[7] ..... B63H 21/32

[52] U.S. Cl. ..... 440/89; 440/900

[58] Field of Search ..... 440/89, 88, 900

[56] References Cited

U.S. PATENT DOCUMENTS 5,049,100 9/1991 Yamamoto et al. ..... 440/89

FOREIGN PATENT DOCUMENTS 4-134626 5/1992 Japan .
6-129224 5/1994 Japan .

*Primary Examiner*—Stephen Avila
*Attorney, Agent, or Firm*—Finnegan, Henderson, Farabow, Garrett & Dunner, L.L.P.

[57] ABSTRACT

An outboard motor includes an engine holder, an engine disposed above the engine holder and the engine includes a cylinder block provided with a plurality of cylinders, a cylinder head disposed behind the cylinder block and a crankcase, a cam chain case through which said engine is mounted on the engine holder, and an exhaust apparatus operatively connected to the cylinder head. The exhaust apparatus includes an exhaust passage formed to the cam chain case, an exhaust manifold connected to the cylinder head, a water jacket formed to the exhaust manifold and another water jacket formed to the exhaust passage. The exhaust passage is formed at a portion near a central portion of the engine having most wide width in association with a lower end portion of the exhaust manifold.

5 Claims, 6 Drawing Sheets

EXHAUST APPARATUS OF OUTBOARD MOTOR

BACKGROUND OF THE INVENTION

The present invention relates to an exhaust apparatus of an outboard motor.

In known art, Japanese Patent Laid-open Publication No. HEI 6-129224 discloses one example of an exhaust apparatus of an outboard motor in which an exhaust passage connected to an exhaust port of a cylinder head is integrally formed in a cylinder block, and Japanese Utility Model Laid-open Publication No. HEI 4-134626 also discloses an exhaust apparatus of an outboard motor in which a separate exhaust manifold is disposed between a cylinder head and an oil pan which is formed with an exhaust passage.

However, in the known art mentioned above, in the exhaust apparatus in which the exhaust passage is integrally formed in the cylinder block, the cylinder block is increased in size and in weight, and its shape is complicated, which increases manufacturing costs. Further, since the exhaust passage is formed in the vicinity of the cylinder, the exhaust heat may thermally deform the cylinder, which is not preferable. Furthermore, since the cylinder and the exhaust apparatus commonly use the same cooling water jacket, it is impossible to adjust the temperature of only the exhaust apparatus.

In order to eliminate the above defects in the prior art, it may be possible to use a separate exhaust manifold. However, since an exhaust port is normally disposed at a location close to a rear portion of the engine, if the exhaust manifold is connected to the exhaust port, a width of the engine is increased, being disadvantageous in terms of layout, and moreover, a shape of an engine cover having stream line (substantially elliptic shape) section may be deformed.

SUMMARY OF THE INVENTION

An object of the present invention is to substantially eliminate defects or drawbacks encountered in the prior art mentioned above and to provide an exhaust apparatus of an outboard motor having an engine with reduced width.

Another object of the present invention is to provide an exhaust apparatus of an outboard motor capable of properly adjusting a temperature of only the exhaust apparatus.

These and other objects can be achieved according to the present invention by providing an exhaust apparatus of an outboard motor having an engine in which a cylinder head is disposed behind, in a state of an outboard motor mounted to a hull, a cylinder block formed with a plurality of vertically disposed cylinders, in which an exhaust apparatus connected to the cylinder head is disposed near a center portion of the engine.

In a preferred embodiment, a cam chain case is disposed below the engine, the cam chain case being provided with an exhaust passage constituting the exhaust apparatus and the exhaust apparatus further comprises an exhaust manifold connected to the cylinder head, the exhaust manifold being connected to the exhaust passage. The exhaust passage is formed at a portion near a central portion of the engine having most wide width in association with a lower end portion of the exhaust manifold.

The exhaust manifold is formed with a water jacket and the exhaust passage is formed with another water jacket, the water jackets being in communication with each other. The water jacket of the exhaust manifold is in communication with an upper end of the exhaust manifold and the exhaust apparatus further comprises a cooling water outlet serving as a water checking port for cooling water.

In a more specified aspect, there is provided an exhaust apparatus of an outboard motor which includes an engine holder, an engine disposed above the engine holder and comprising a cylinder block provided with a plurality of cylinders, a cylinder head disposed behind the cylinder block, in an installed state of the outboard motor, a crankcase, a cam chain case through which the engine is mounted on the engine holder, and an exhaust apparatus operatively connected to the cylinder head, the exhaust apparatus comprising an exhaust passage formed to the cam chain case, an exhaust manifold connected to the cylinder head, a water jacket formed to the exhaust manifold and another water jacket formed to the exhaust passage, wherein the exhaust passage is formed at a portion near a central portion of the engine having most wide width in association with a lower end portion of the exhaust manifold.

According to the structure of the exhaust apparatus of the outboard motor, the exhaust apparatus is disposed near the central portion of the engine so as to reduce the increasing of the width thereof, and the two water jackets are formed independently, so that the temperature of the exhaust apparatus can be adjusted alone.

The nature and further characteristic features of the present invention will be made more clear from the following descriptions made with reference to the accompanying drawings.

DESCRIPTION OF THE PREFERRED EMBODIMENT

An embodiment of the present invention will be described hereunder with reference to the accompanying drawings.

Figure 1:
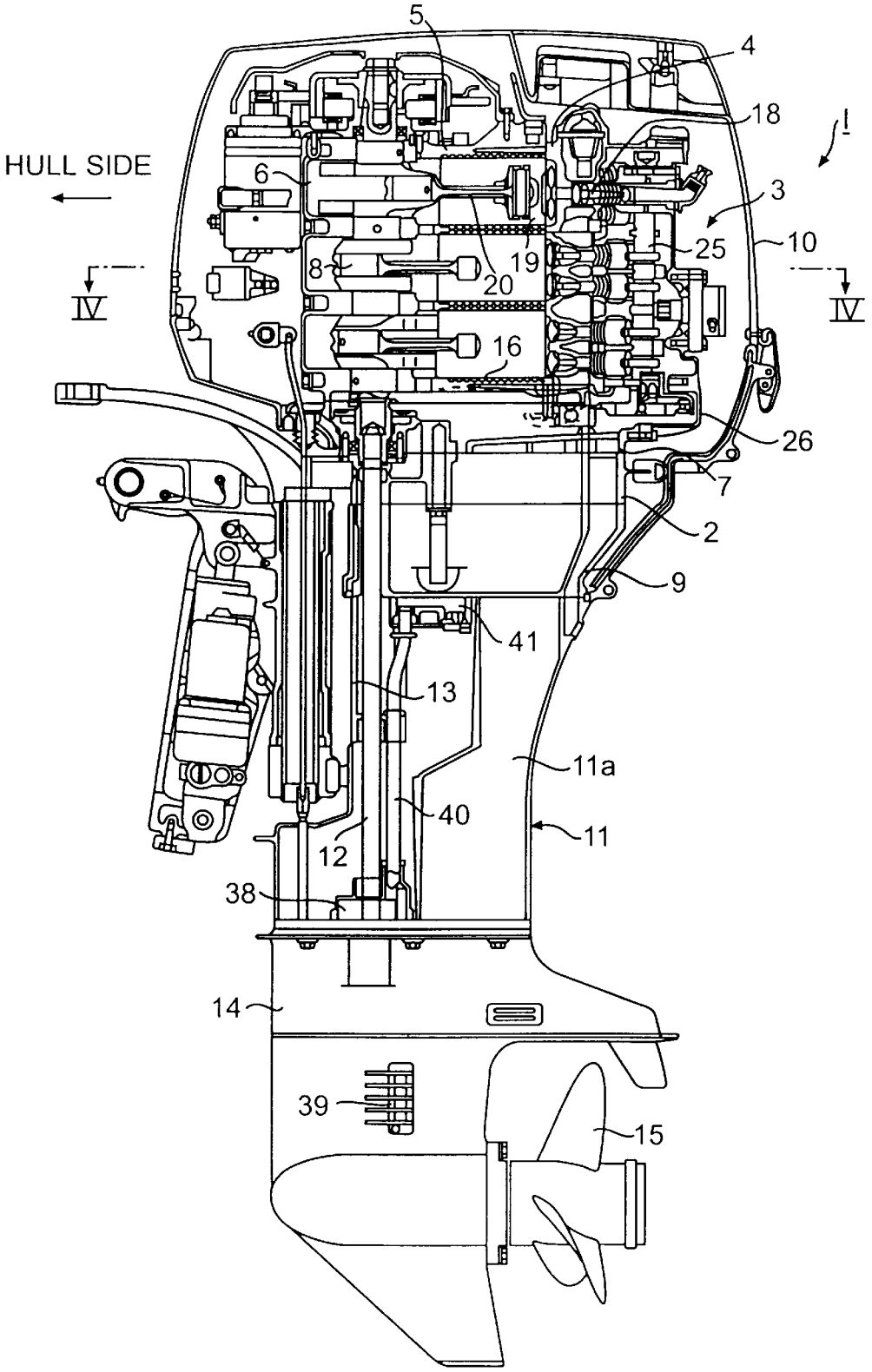
FIG. 1 is a left side longitudinal sectional view of an outboard motor of an embodiment provided with an exhaust apparatus of the present invention.
Figure 2:
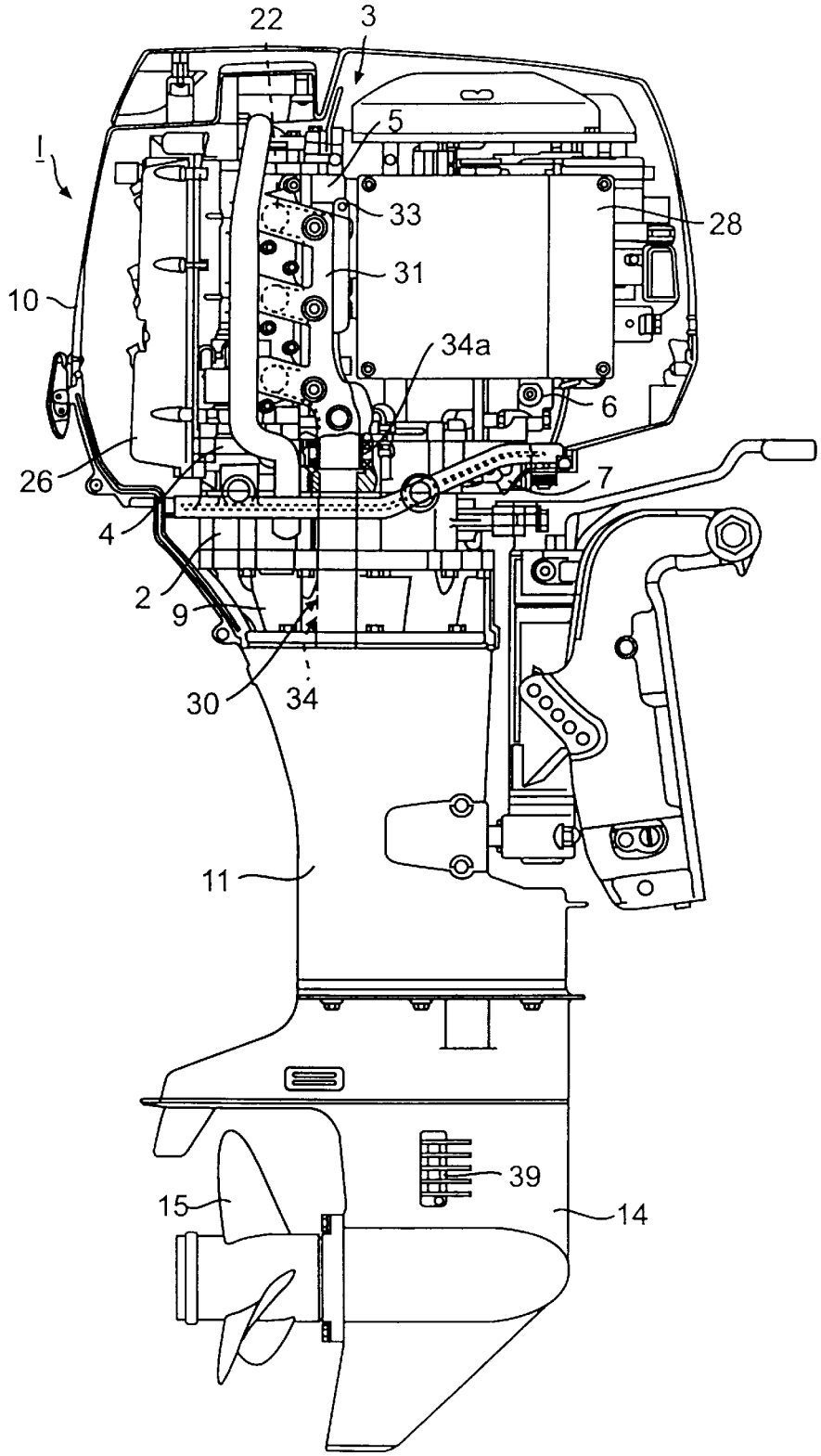
FIG. 2 is a right side view of the outboard motor shown in FIG. 1.

Referring to FIGS. 1 and 2, an outboard motor 1 includes an engine holder 2 and an engine 3 disposed above the engine holder 2. The engine 3 is a water-cooled three-cylinder engine and comprises a cylinder head 4, a cylinder block 5, a crankcase 6 and the like. The engine 3 is mounted on the engine holder 2 through a cam chain case 7.

The cylinder block 5 is disposed in a rearward position (right side in FIG. 1) of the crankcase 6. A cylinder head 4 is disposed in a rearward position of the cylinder block 5. The cam chain case 7 is disposed below the crankcase 6, the cylinder block 5 and the cylinder head 4.

A crankshaft 8 is vertically disposed within the crankcase 6, and an oil pan 9 is disposed below the engine holder 2. An engine cover 10 covers an area from the engine 3 to the oil pan 9.

A drive shaft housing 11, in which a drive shaft is accommodated, is disposed below the oil pan 9. An upper end portion of the drive shaft 12 is, for example, spline-fitted to a lower end portion of the crankshaft 8. The drive shaft 12 extends downward in a shaft pipe 13 formed within the drive shaft housing 11, and the drive shaft 12 drives a propeller 15 through a bevel gear and a propeller shaft (both not shown) in a gear case 14 provided below the drive shaft housing 11.

Figure 3:
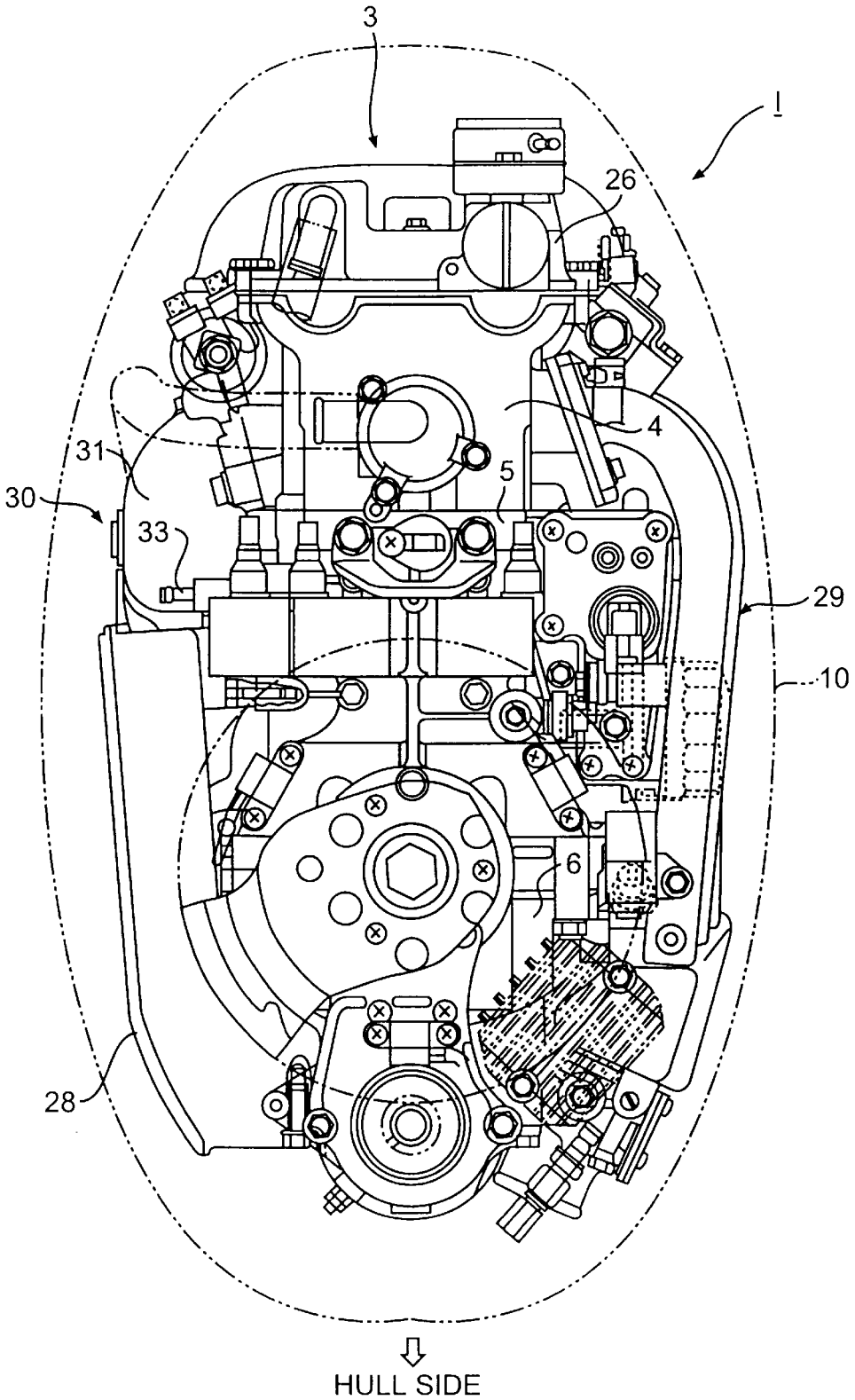
FIG. 3 is a plan view of the outboard motor shown in FIG. 1.
Figure 4:
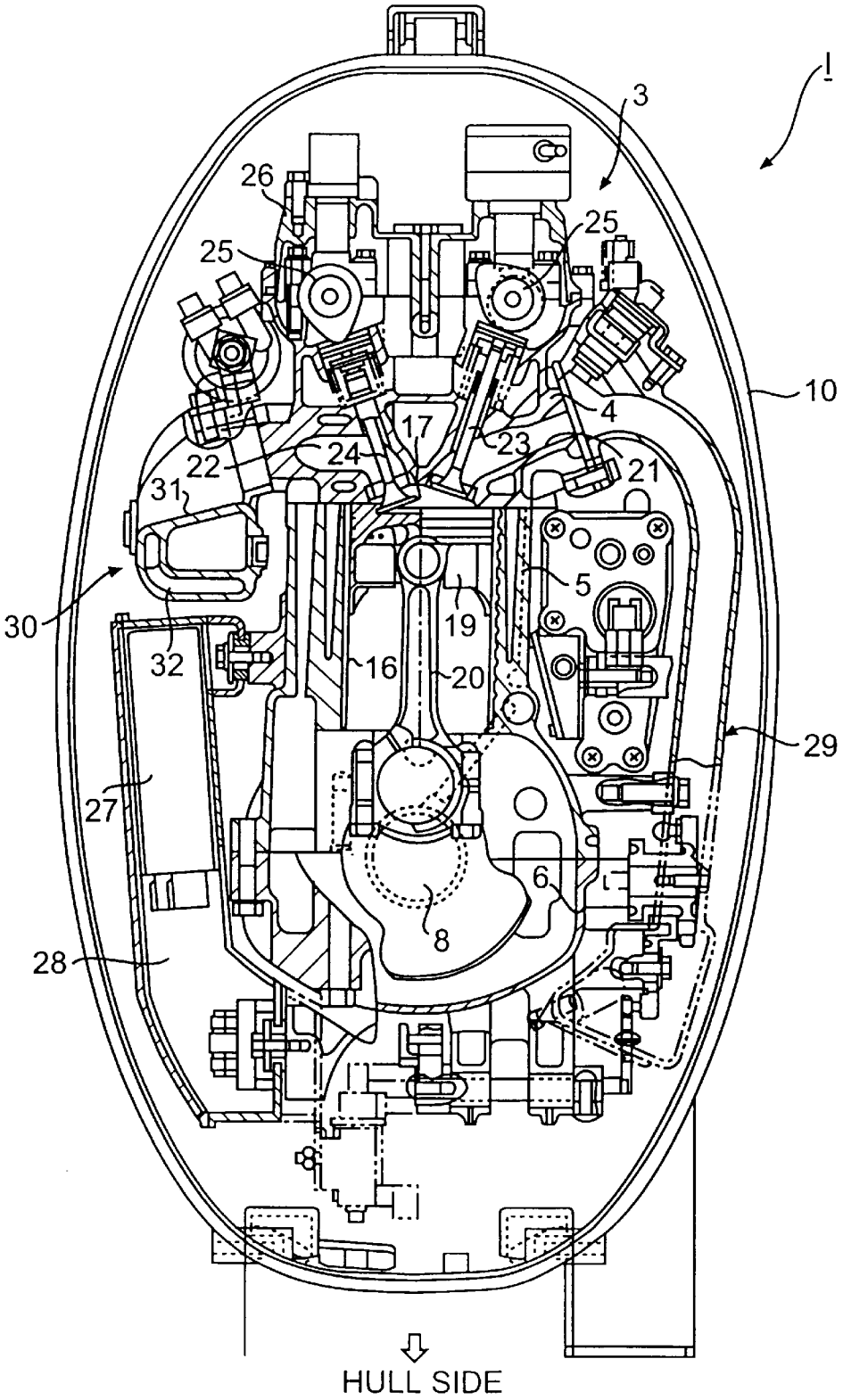
FIG. 4 is a sectional view taken along the line IV—IV in FIG. 1.

FIG. 3 is a plan view of the outboard motor 1, and FIG. 4 is a sectional view taken along the line IV—IV in FIG. 1. As shown in FIGS. 3 and 4, the engine components are designed such that substantially the center portion of the engine 3 has the widest width and the engine 3 is tapered toward front and rear portions thereof. Shapes and designs of the engine components are set so that they can be accommodated within the engine cover 10 having stream line (substantially elliptic shape) horizontal section.

As shown in FIGS. 1 to 4, three cylinders 16 each formed horizontally are vertically arranged within the cylinder block 5 in a state of the outboard motor mounted to a hull, for example. A combustion chamber 17 which is aligned with the cylinders 16 is formed in the cylinder head 4, and a spark plug 18 is coupled from the outside of the combustion chamber 17. A piston 19 is slidably inserted into each of the cylinders 16 in a horizontal direction, and the piston 19 and the crankshaft 8 are connected through a connecting rod 20. Reciprocal stroke of the piston 19 is converted into a revolutional movement of the crankshaft 8.

An intake port 21 and an exhaust port 22 are formed in the cylinder head 4. An intake valve 23 and an exhaust valve 24 for opening and closing the intake port 21 and the exhaust port 22, respectively, are disposed in the cylinder head 4, and a camshaft 25 for opening and closing these valves 23 and 24 is disposed in a rear portion of the cylinder head 4. A cam chain (not shown) is disposed in the cam chain case 7, and the camshaft 25 and the crankshaft 8 are operatively connected by means of the cam chain. A rear portion of the cylinder head 4 is covered with a cylinder head cover 26.

As shown in FIGS. 2 to 4, an electrical component box 28 accommodating an electrical component 27, an intake apparatus 29, an exhaust apparatus 30 and the like are disposed around the engine 3. The intake apparatus 29 is disposed on the one side of the engine 3, and the electrical component box 28 and the exhaust apparatus 30 are disposed on the other side of the intake apparatus 29.

An exhaust manifold 31 constituting the exhaust apparatus 30 is connected to the exhaust port 22. The exhaust manifold 31 once extends in a lateral direction toward the center portion of the engine 3 having the widest width and then extends downward.

A water jacket 32 for cooling the exhaust manifold 31 is formed around the exhaust manifold 31. A cooling water outlet 33 which is in communication with the water jacket 32 is provided at an upper end of the exhaust manifold 31. Further, the cooling water outlet 33 is designed as as to also function as a water checking port for the cooling water.

Figure 5:
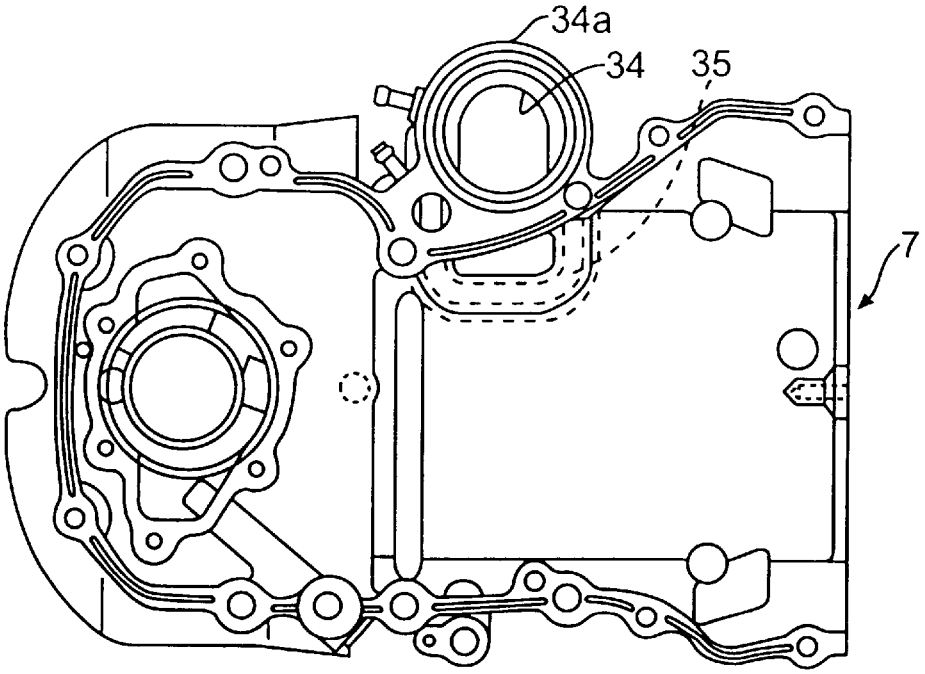
FIG. 5 is a plan view of a cam chain case of the embodiment shown in FIG. 1.
Figure 6:
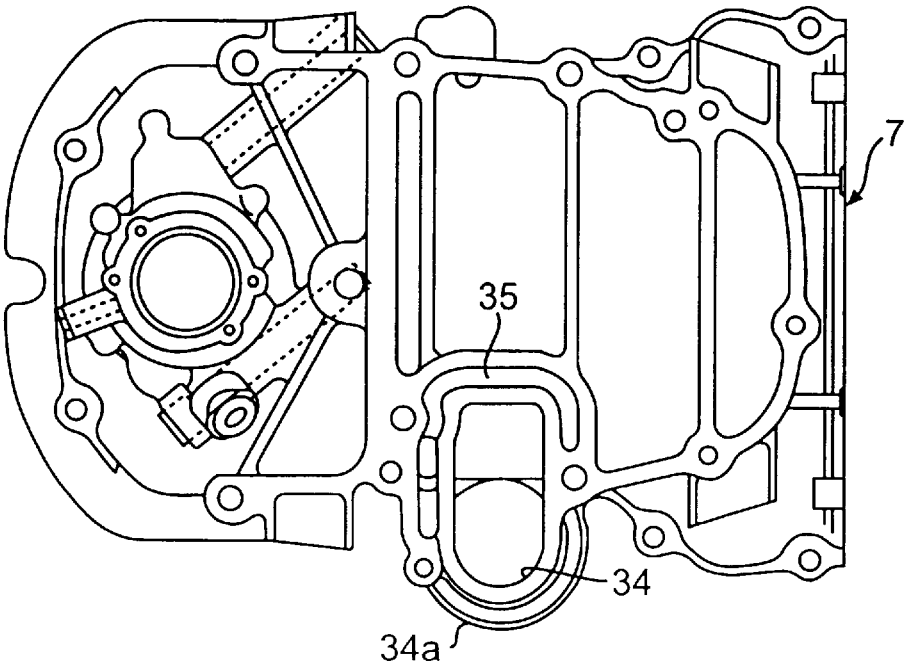
FIG. 6 is a bottom view of the cam chain case.

FIG. 5 is a plan view of the cam chain case 7 and FIG. 6 is a bottom view of the cam chain case 7. As shown in FIGS. 2 and 5, an exhaust passage 34 constituting the exhaust apparatus 30 is formed such that it vertically passes through the cam chain case 7, the engine holder 2 and the oil pan 9. The exhaust passage 34 is disposed in the engine 3 closer to the center portion thereof having the widest width in accordance with a position of a lower end portion of the exhaust manifold 31.

A connection portion 34*a* is formed on an upper end of the exhaust passage 34 formed in the cam chain case 7, and a lower end portion of the exhaust manifold 31 is connected to the connection portion 34*a*. A lower end of the exhaust passage 34 is opened toward an exhaust expansion chamber 11*a* formed in the drive shaft housing 11. A water jacket 35 is formed around the exhaust passage 34.

Figure 7:
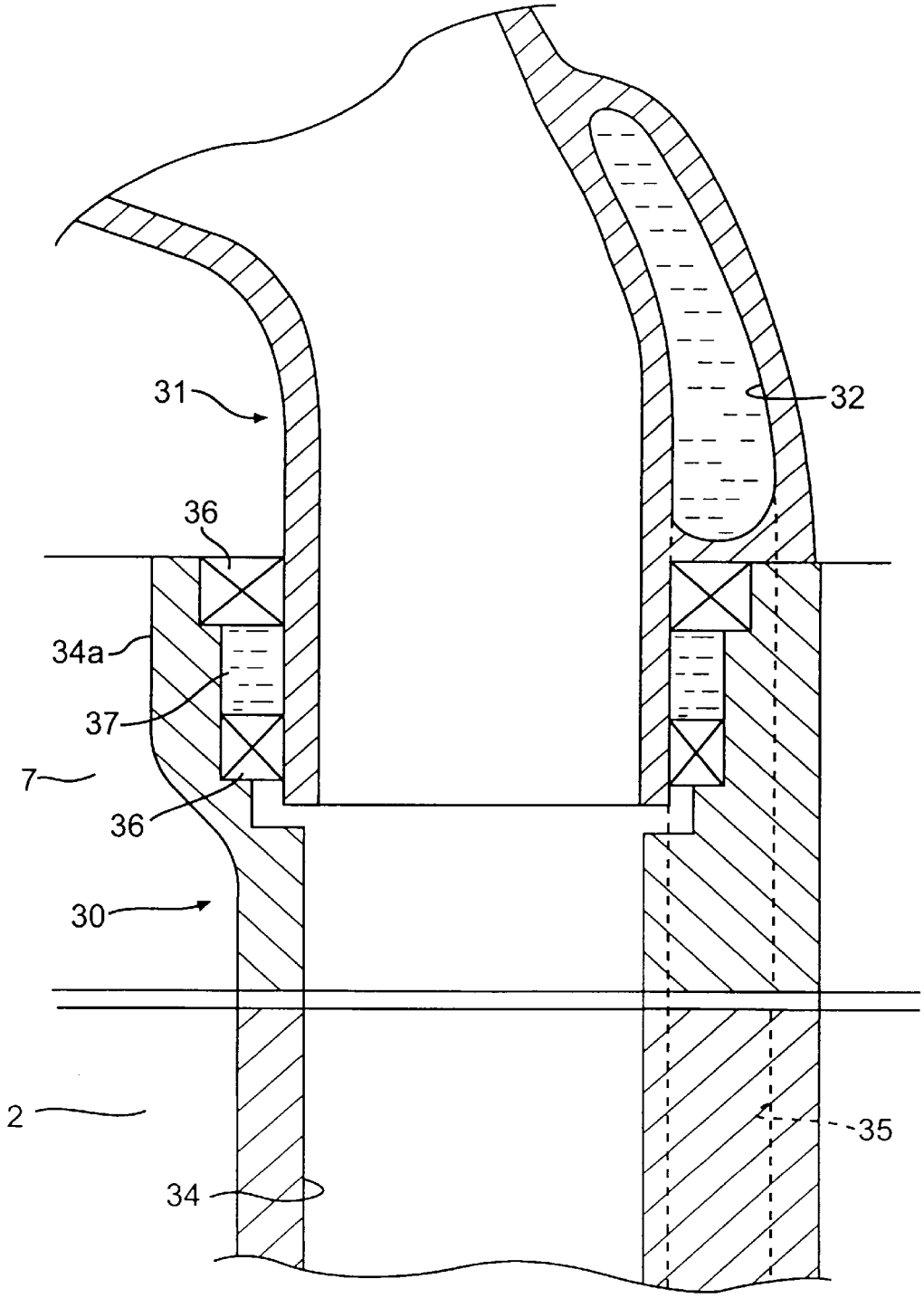
FIG. 7 is an enlarged sectional view of a connecting portion of an exhaust manifold.

FIG. 7 is an enlarged cross section of the connection portion 34*a* of the exhaust manifold 31. As shown in FIG. 7, upper and lower separate seal members 36 are provided in the connection portion 34*a*. The water jacket 32 of the exhaust manifold 31 and the water jacket 35 of the exhaust passage 34 are in communication with each other, and cooling water is introduced into a space 37 between the upper and lower seal members 36.

The exhaust apparatus of the outboard motor of the structure described above will operates as follows.

As shown in FIG. 1, for example, cooling water is pumped up from a water intake 39 of the gear case 14 by a water pump 38 which is driven by the drive shaft 12 and is introduced into a relief valve 41 provided at a lower portion of the oil pan 9 through a water pipe 40 and is then introduced into the water jacket 35 of the exhaust passage 34. The cooling water, which has cooled the exhaust passage 34, then cools a portion between the seal members 36 of the connection portion 34*a* of the exhaust manifold 31, and then, the cooling water is introduced into the water jacket 32 of the exhaust manifold 31. The cooling water which has cooled the exhaust manifold 31 is discharged from the cooling water outlet 33 formed in the upper end of the exhaust manifold 31.

As mentioned above, the engine components are designed so that the center portion of the engine 3 has the widest width, and the exhaust manifold 31 and the exhaust passage 34 are disposed around the center portion of the engine 3. Therefore, the width of the engine 3 is not increased, and the stream line section of the engine cover 10 can be maintained.

Further, the exhaust manifold 31 is connected to the connection portion 34*a* on the upper end of the exhaust passage 34 formed in the cam chain case 7, the water jacket 32 of the exhaust manifold 31 and the water jacket 35 of the exhaust passage 34 are in communication with each other, and the cooling water outlet 33 is provided at the upper end of the exhaust manifold 31. Therefore, since the cooling system of the exhaust apparatus 30 is separated from other cooling systems of the engine 3, it is possible to independently adjust the temperature of the exhaust apparatus 30.

Since the cooling water outlet 33 is designed so as to also function as the water checking port for the cooling water, it is unnecessary to newly form a water checking port, so that the number of parts and costs can be reduced.

Further, the connection portion 34*a* of the exhaust manifold 31 is provided with the upper and lower double seal members 36, and the cooling water is introduced into the space 37 between these seal members 36. Therefore, as a material of the seal member 36, a rubber having a high sealing property can be used although it has a low heat resistance. As a result, the sealing property and a reliability of the connection portion 34*a* are enhanced.

It is to be noted that the present invention is not limited to the described embodiment and many other changes and modifications may be made without departing from the scopes of the appended claims.

What is claimed is:

1. In an exhaust apparatus of an outboard motor having an engine in which a cylinder head is disposed behind, in an installed state of the outboard motor, a cylinder block formed with a plurality of vertically disposed cylinders, and a cam chain case disposed below said engine, the improvement in which an exhaust apparatus connected to said cylinder head is disposed near a center portion of said engine, and wherein an exhaust passage of said cam chain case constitutes a part of said exhaust apparatus and said exhaust apparatus further comprises an exhaust manifold connected to said cylinder head, said exhaust manifold being connected to said exhaust passage.

2. An exhaust apparatus of an outboard motor according to claim 1, wherein said exhaust passage is formed at a portion near a central portion of the engine having most wide width in association with a lower end portion of the exhaust manifold.

3. An exhaust apparatus of an outboard motor according to claim 1, wherein said exhaust manifold is formed with a water jacket and said exhaust passage is formed with another water jacket, said water jackets being in communication with each other.

4. An exhaust apparatus of an outboard motor according to claim 3, wherein said water jacket of said exhaust manifold is in communication with an upper end of said exhaust manifold and said exhaust apparatus further comprises a cooling water outlet which also functions as a water checking port for cooling water.

5. An exhaust apparatus of an outboard motor which includes an engine holder, an engine disposed above the engine holder and comprising a cylinder block provided with a plurality of cylinders, a cylinder head disposed behind the cylinder block in an installed state of the outboard motor, a crankcase, a cam chain case through which said engine is mounted on the engine holder, and an exhaust apparatus operatively connected to the cylinder head, said exhaust apparatus comprising an exhaust passage formed to the cam chain case, an exhaust manifold connected to the cylinder head, a water jacket formed to the exhaust manifold and another water jacket formed to the exhaust passage, wherein said exhaust passage is formed at a portion near a central portion of the engine having most wide width in association with a lower end portion of the exhaust manifold.

* * * * *